US007017214B2

(12) United States Patent
Bard

(10) Patent No.: US 7,017,214 B2
(45) Date of Patent: Mar. 28, 2006

(54) WATER PILLOW WITH RESTRICTED FLOW

(75) Inventor: Maurice R. Bard, Markham (CA)

(73) Assignee: IWI Ltd., Markham (CA)

( * ) Notice: Subject to any disclaimer, the term of this patent is extended or adjusted under 35 U.S.C. 154(b) by 0 days.

(21) Appl. No.: 10/845,179

(22) Filed: May 14, 2004

(65) Prior Publication Data

US 2005/0251919 A1 Nov. 17, 2005

(51) Int. Cl.
*A47G 9/00* (2006.01)

(52) U.S. Cl. ..... 5/644; 5/636

(58) Field of Classification Search ..... 5/636, 5/644, 654, 655.5

See application file for complete search history.

(56) References Cited

U.S. PATENT DOCUMENTS

| | | | | |
|---|---|---|---|---|
| 1,726,939 A | | 9/1929 | Anderson | |
| 2,728,926 A | * | 1/1956 | Emery | 5/644 |
| 3,115,647 A | | 12/1963 | Emery | |
| 3,900,910 A | * | 8/1975 | Nakata | 5/644 |
| 4,115,885 A | | 9/1978 | Davis | |
| D298,716 S | | 11/1988 | Kaplan | |
| D346,087 S | | 4/1994 | Von Heck | |
| 5,522,105 A | * | 6/1996 | Fujiwara et al. | 5/644 |
| 5,708,998 A | | 1/1998 | Torbik | |
| 6,487,737 B1 | * | 12/2002 | Futagami | 5/644 |

FOREIGN PATENT DOCUMENTS

| | | |
|---|---|---|
| CA | 2314440 | 1/2002 |
| DE | 4126681 | 2/1993 |
| FR | 2652998 | 4/1991 |
| JP | 2002172128 | 6/2002 |

* cited by examiner

*Primary Examiner*—Heather Shackelford
*Assistant Examiner*—Fredrick Conley

(57) ABSTRACT

A water based pillow includes a common fluid retaining envelope which is divided into two elongate regions having different fluid support and fluid dynamic characteristics. One region is basically uninterrupted while a second region has a series of heat seal islands joining opposed sides of the envelope. These heat seal islands reduce the amount of fluid retained in the second region. This second region is preferably the head support region and under load. Some fluid is displaced from this region and enters the first region which is preferably the neck support region. The amount of fluid in the envelope can be adjusted or set to maintain a thin layer of fluid beneath the user's head.

9 Claims, 4 Drawing Sheets

WATER PILLOW WITH RESTRICTED FLOW

FIELD OF THE INVENTION

The present invention relates to water pillows and in particular, relates to water pillows having a desirable distribution of a water support layer maintained within an envelope.

BACKGROUND OF THE INVENTION

A water based pillow is disclosed in my earlier U.S. Pat. No. 4,847,931 and U.S. Pat. No. 4,896,388 where a water envelope is positioned adjacent a base portion of a pillow and supports a compressible fill material thereabove. This pillow has proven quite successful and has been found to assist those who suffer from headaches and neck pain.

Other pillows have used an air bladder for supporting of a compressible fill material, however, these pillows have not proven particularly effective. In addition, some pillows have used a fluid retaining envelope with a series of partitions or partial seals for modifying the fluid distribution in the pillow. For example, my co-pending Canadian Patent 2,314,440 discloses a number of envelope designs where different seal areas are provided for modifying the distribution of fluid and fluid flow within the envelope.

In a pillow having an envelope for receiving of a fluid such as water, there are applications where it is desirable to modify the envelope in a manner to reduce the amount of fluid necessary for the pillow to provide the same desired fluid support and fluid flow characteristics. The reduction in fluid would reduce the weight of the pillow and also reduce the thermal mass of the fluid layer.

Various attempts to produce a water pillow which operates in a satisfactory manner and has reduced weight have been proposed, however, these attempts have not been successful.

The present invention provides a water based pillow with improved water distribution properties for providing specific head and neck support.

SUMMARY OF THE INVENTION

A pillow according to the present invention comprises an outer ticking casing, a fill material contained within the ticking casing, and a fluid retaining envelope within the ticking. The fluid retaining envelope is divided in a manner to define a neck support portion and a head support portion. The neck support portion is bound along a longitudinal edge by a continuous seal and opens onto and is in fluid communication with the head support portion along an opposite longitudinal edge. The head support portion has a series of intermediate seals joining the envelope intermediate its length and width restricting the amount of fluid which is retained in the head support position relative to the neck support position. The neck support portion with fluid retained in said envelope is more responsive and has a higher variation in thickness relative to the head support portion when the pillow is used to support a person's head and neck.

According to an aspect of the invention, the head support portion includes a series of heat sealed islands at spaced positions in the head support portion with each heat sealed island forming a connection area of said envelope.

In yet a further aspect of the invention, each heat sealed island is elongate with rounded ends.

In yet a further aspect of the invention, each heat sealed island has a peripheral seal surrounding an unsealed portion.

In yet a further aspect of the invention, the envelope is generally rectangular with a single fill plug provide adjacent one end of the neck portion.

In yet a further aspect of the invention, the neck support portion and the head support portion generally equally divide the envelope longitudinally.

In yet a further aspect of the invention, the pillow is elongate and each of the neck support portion and the head support portion are elongate.

In yet a further aspect of the invention, the series of heat sealed islands include a first series of islands adjacent one longitudinal edge of the envelope and a second series of islands separated from said one longitudinal edge by said first series of said islands.

In a further aspect of the invention, heat sealed sealable island includes a continuous peripheral seal surrounding an unsealed portion.

In yet a further aspect of the invention, the first series of islands includes at least four islands.

In a further aspect of the invention, the second series of islands includes at least three islands.

According to a further aspect of the invention, each island is about three centimeters in length.

In yet a further aspect of the invention, the second series of islands are positioned in an arc-shaped pattern across the envelope and centered thereon.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 3:
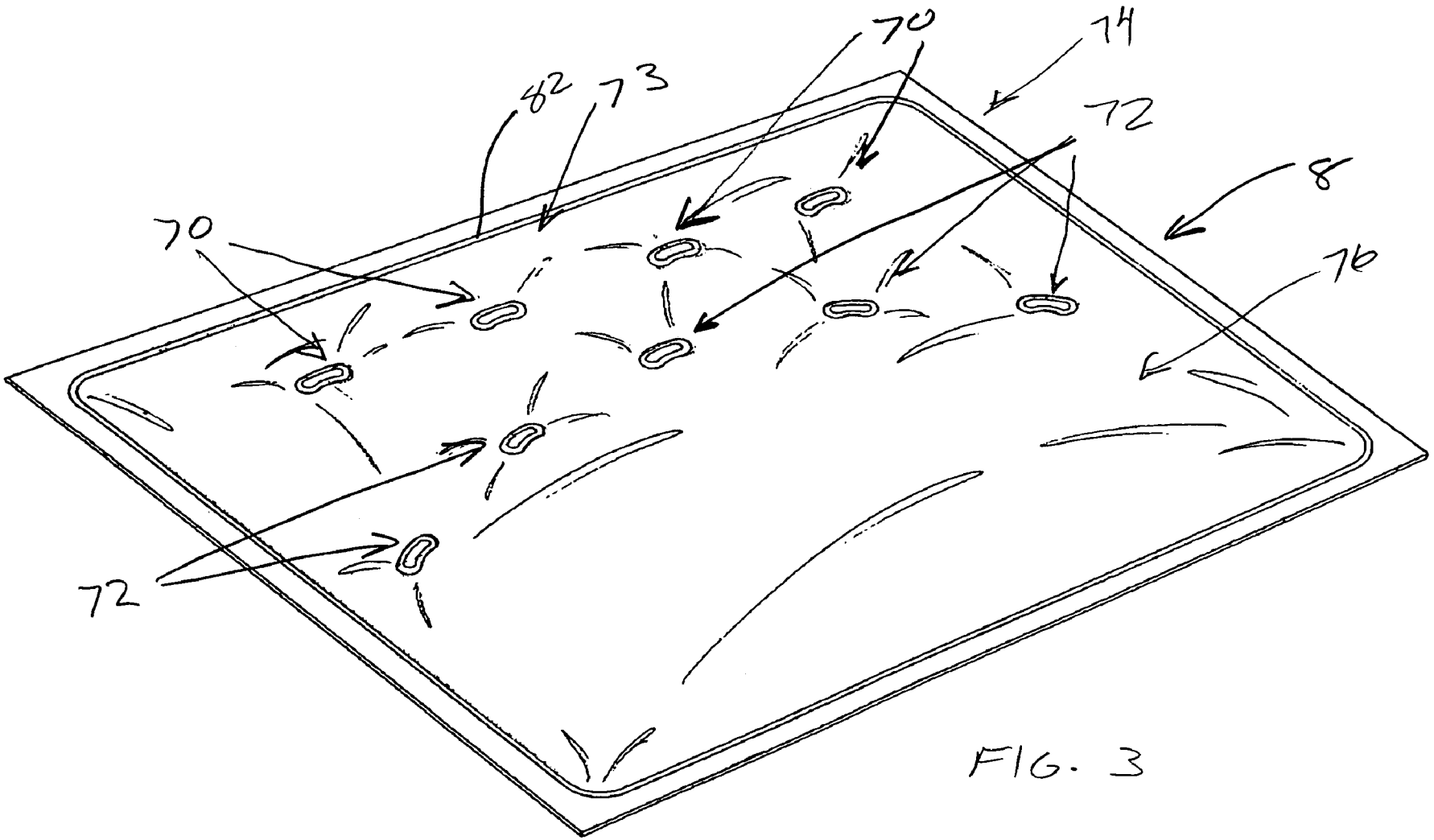
FIG. 3 is a perspective view of the envelope with some fluid retained in the envelope.
Figure 4:
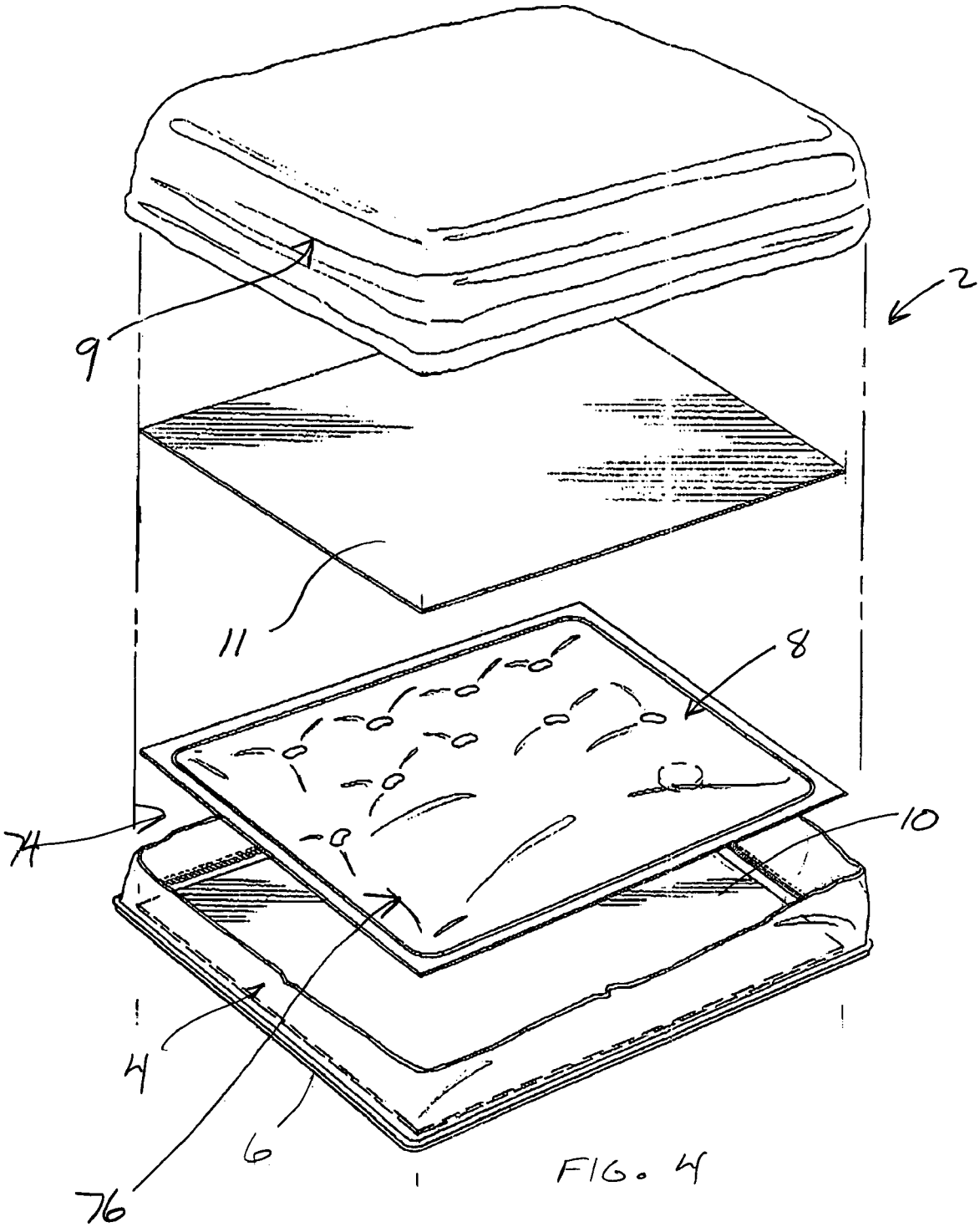
FIG. 4 is a partial exploded assembly view of the pillow.
Figure 5:
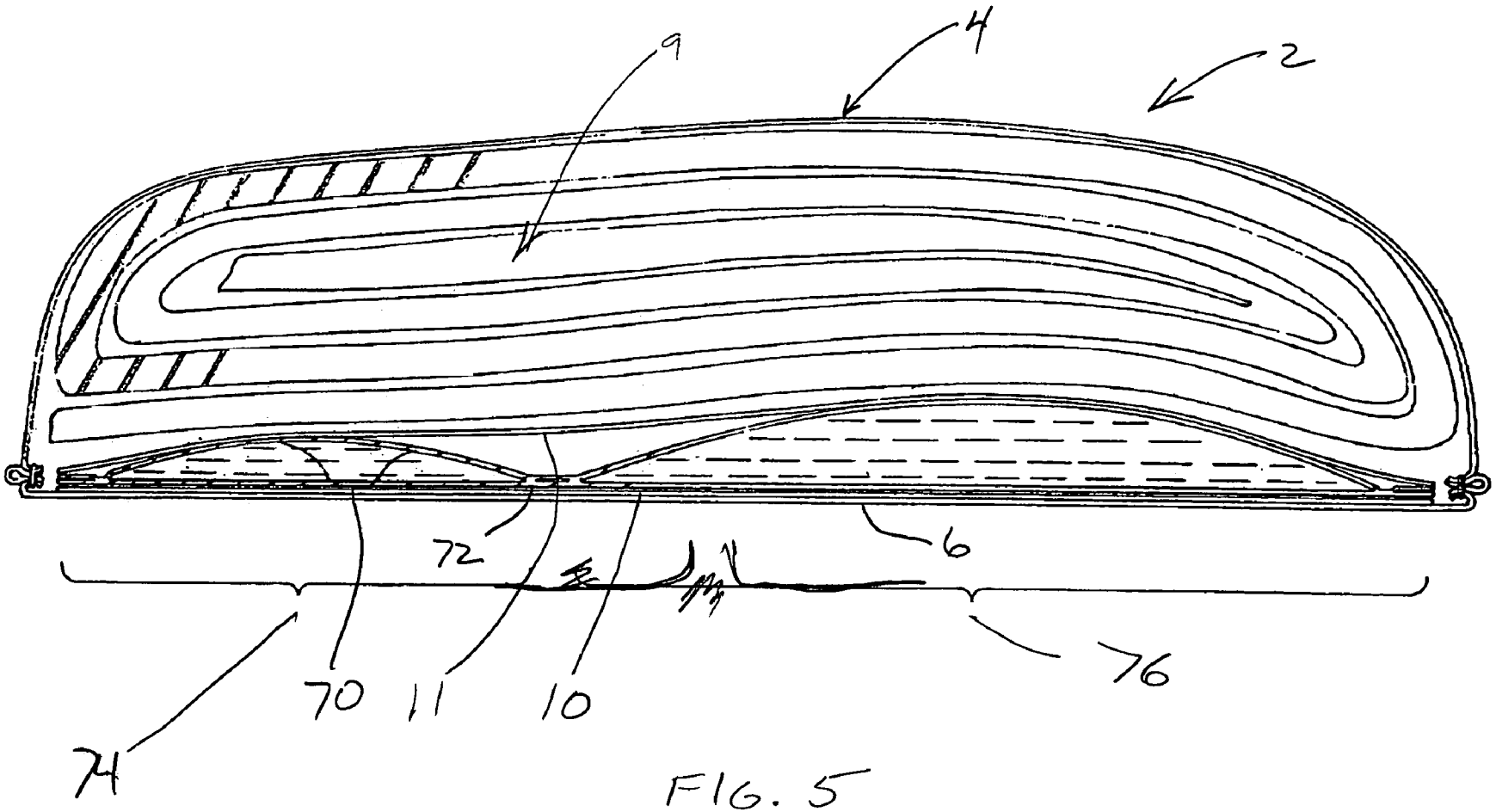
FIG. 5 is a sectional view of the pillow.

The water based pillow 2 shown in FIGS. 3 and 5 has a ticking casing 4 which is typically of a cotton or other suitable fabric. The fluid retaining envelope 8 is attached to a bottom surface 6 of the casing, preferably by stitching or other suitable securement. A compressible fill material 9 is provided above the fluid retaining envelope and can be of a fiber, foam, feather or other suitable material. Positioned between the fluid retaining envelope 8 and the ticking casing 4 is a heat reflecting layer 10. This heat reflecting layer serves to isolate the heat sink characteristics of the fluid in the envelope from a person's skin if an arm or other part is inserted beneath the pillow. A similar heat reflecting layer 11 preferably is provided the top side of the envelope. This layer forms a thermal barrier and also serves to protect the fluid retaining envelope 8.

The envelope 8 as shown in FIG. 3 has a first series of heat sealable islands 70 and a second series of heat sealable islands 72. These islands are provided adjacent an upper portion 73 of the elongate envelope 8 and collectively, define in combination with that portion on the envelope thereabove, a head support area generally indicated as 74. This head support area is in contrast to the elongate neck support area 76 provided immediately to one side of the head support area. The envelope in the neck support area 76 does not include any interior heat seal islands, and as such, is more responsive to changes in loads applied to the pillow. In particular, the height variations of the envelope of the neck support and fluid flow characteristics, are more pronounced relative to the head support area. The envelope beneath the head support area has less water due to the heat sealed islands 70 and 72 and the height variation due to fluid flow is also limited by the heat sealed islands.

As can be appreciated from FIG. 5, the neck support area 76 can have a substantial thickness variation across its length when supporting a load, whereas the heat sealed islands serve to restrict the height variation in the head support area 74. This arrangement has been found to be particularly effective as the fluid displaced from the head support portion moves into the neck support position and cradles the neck of the user. The fluid in the neck support portion is very responsive to changes in position and provides a gentle massaging action. The amount of fluid retained in the head support area 74 is less and this fluid is somewhat less responsive. It has been found that this reduction in fluid and dampened response, is not particularly troublesome and the fluid has been directed to the neck support area where the additional support has been found to be helpful and often therapeutic. Also, the fluid flow variations due to change in the support load tend to dissipate faster with the present envelope.

Figure 1:
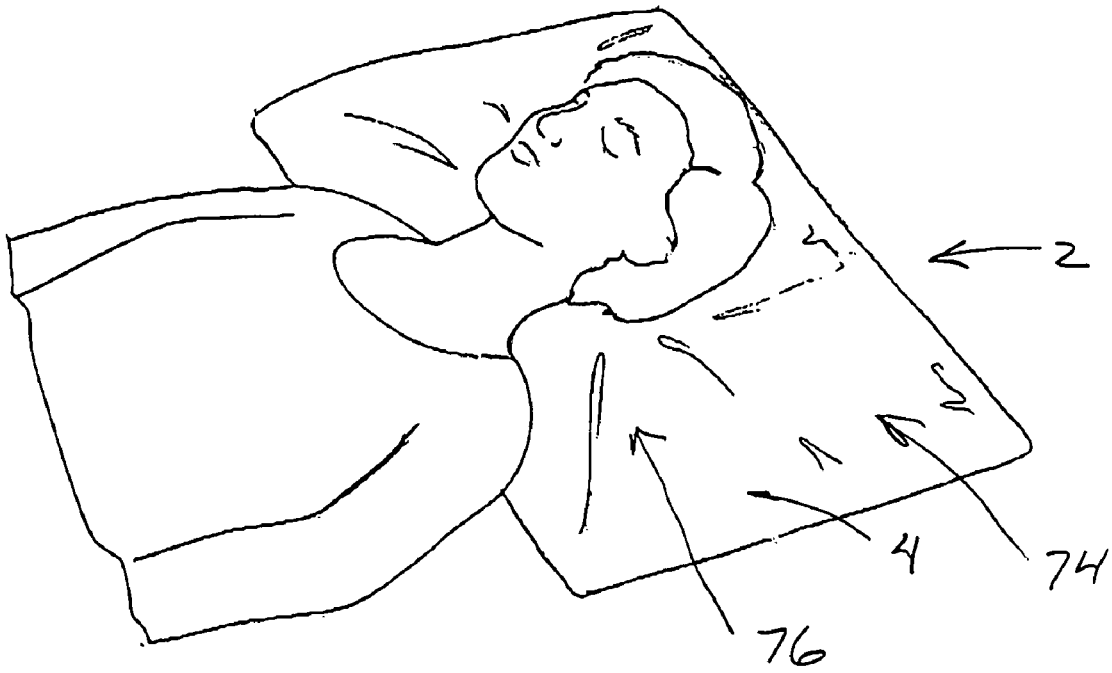
FIG. 1 is a perspective view of the pillow.
Figure 2:
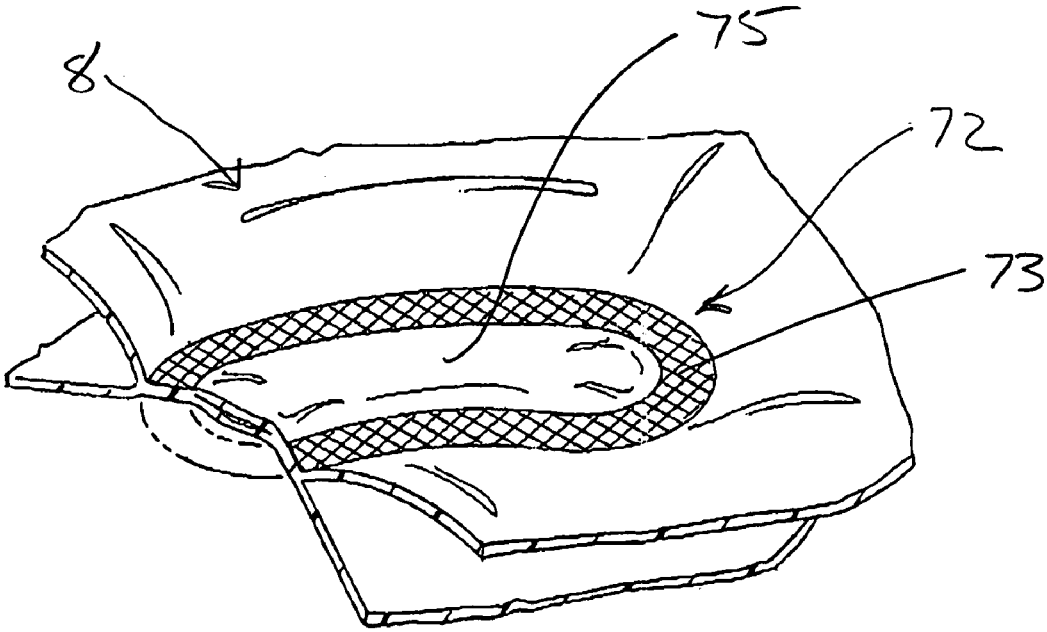
FIG. 2 is a partial perspective cutaway view showing a seal area of the fluid retaining envelope.

As shown in FIG. 2 and the perspective view of FIG. 3, each heat sealed island 72 is generally elongate and has a peripheral seal 73 surrounding a center unsealed portion 75. This heat seal design is quite effective and reduces or has a greater tolerance to high stress. With this tolerance, problems associated with tears or failure of the envelope are avoided. It is believed the island peripheral seal extends the heat seal area and reduces high stress points. The first series of islands 70 have four islands spaced approximately four inches from the longitudinal heat seal edge 82 and a second series of islands comprising five heat sealed islands 72 which is positioned between the islands of the first series. This second series of islands is laid out in an arc pattern such that the outer islands are slightly closer to the base of the envelope. The head support area and the neck support area generally equally divide the envelope 8 longitudinally. Preferably the heat seal islands have a kidney shaped peripheral seal found to be effective in reducing high stress points.

With this arrangement, the fluid that is retained in the head portion 74 of the envelope 8 is significantly reduced and thus the weight of the pillow and the thermal mass of the pillow is substantially reduced. This reduction in the amount of fluid has been accomplished without sacrificing the wrapping or cradling action of the fluid envelope supporting the neck of a user. Similarly, the neck support area remains in efficient fluid communication with the head support area. The use of island seals allows this efficient fluid communication while providing the desired support. The fluid dynamics of the pillow have been marginally dampened, due to the reduction in volume of fluid in the head support area, however, the desirable support of the head of the user on a thin fluid layer, in combination with the cradling support of the neck has been maintained. Some users may also prefer the pillow due to the dampened fluid response. This fluid response and support can also be varied by adjusting the fill volume. The layout of the heat seal areas and the spacing thereof from the periphery of the outer heat seal boundary has been found to be practical in maintaining the integrity of the envelope for the expected life of the pillow.

The modified water based pillow 2 has described the pillow with respect to the preferred head support area having a restricted fluid volume and restricted fluid flow and the neck support area. It is possible to use the pillow in the reverse orientation where the head support area and the neck support area are reversed. A user may find this orientation preferable, for example, if he does not desire the responsible neck cradling action of the "neck support portion". Thus, the head support portion is an elongate portion of reduced fluid and less responsive fluid dynamics and the neck support portion is an elongate portion having more fluid and high fluid dynamics.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A pillow comprising an outer ticking casing, a fill material contained within said ticking casing, and a fluid retaining envelope within said ticking, said fluid retaining envelope being divided in a manner to define a first elongate support portion and a second elongate support portion, said first elongate support portion being bound along a longitudinal edge by a continuous seal and opening onto and in fluid communication with said second elongate support portion along an opposite longitudinal edge, said second elongate support portion having a series of intermediate seals joining said envelope intermediate its length and width restricting the amount of fluid which is retained in said second elongate support portion relative to said first elongate support portion, said first elongate support portion with fluid retained in said envelope being more responsive and having a higher variation in thickness relative to said second elongate support portion when said pillow is used to support a person's head and neck; wherein said series of intermediate seals includes a series of heat sealed islands distributed through said second elongate support portion with each heat seal island forming a peripheral seal about an unsealed portion; and wherein said series of heat sealed islands include a first series of islands adjacent one longitudinal edge of said envelope and a second series of islands separated from said one longitudinal edge by said first series of islands wherein said first series of islands includes at least 4 islands and said second series of islands include at least 3 heat sealed islands and said second series of islands are positioned in an arc shaped pattern across said enveloped and centered thereon.

2. A pillow as claimed in claim 1 wherein said first elongate support portion is a neck support portion and said second elongate support portion is a head support portion.

3. A pillow as claimed in claim 1 wherein each sealed island includes a continuous peripheral seal surrounding an unsealed portion.

4. A pillow as claimed in claim 1 wherein each heat seal island is elongate with rounded ends.

5. A pillow as claimed in claim 1 wherein said envelope is generally rectangular with a single fill plug provided adjacent one end of said first elongate support portion.

6. A pillow as claimed in claim 5 wherein said first elongate support portion and said second elongate support portion are approximately of the same area.

7. A pillow as claimed in claim 1 wherein said envelope is attached to said ticking casing.

8. A pillow as claimed in claim 1 wherein said envelope is of a double wall thickness.

9. A pillow as claimed in claim 1 wherein each island is about 3 cm. in length.

* * * * *